US005273405A

United States Patent [19]

Chalmers et al.

[11] Patent Number: 5,273,405

[45] Date of Patent: Dec. 28, 1993

[54] FLUID CUSHIONING APPARATUS FOR HYDRAULIC INTENSIFIER ASSEMBLY

[75] Inventors: Eric J. Chalmers, Minneapolis; David P. LaFavor, Lakeville, both of Minn.

[73] Assignee: Jet Edge, Inc., Minneapolis, Minn.

[21] Appl. No.: 909,865

[22] Filed: Jul. 7, 1992

[51] Int. Cl.[5] ..... F04B 1/28; F04B 21/08

[52] U.S. Cl. ..... 417/397; 92/85 B

[58] Field of Search ..... 417/397; 92/85 B

[56] References Cited

U.S. PATENT DOCUMENTS

| | | | |
|---|---|---|---|
| 1,119,889 | 12/1914 | Skinner . | |
| 2,652,780 | 9/1953 | Adams . | |
| 3,070,023 | 12/1962 | Glasgow | 417/397 |
| 3,136,228 | 2/1962 | Dailey . | |
| 3,888,054 | 6/1975 | Maselli . | |
| 3,890,064 | 6/1975 | Boehringer et al. . | |
| 4,006,666 | 2/1977 | Murray . | |
| 4,069,749 | 1/1978 | Olson et al. . | |
| 4,179,983 | 12/1979 | Wallace . | |
| 4,343,228 | 8/1982 | Wallis . | |
| 4,449,332 | 5/1984 | Griffiths . | |
| 4,517,878 | 5/1985 | Hashimoto et al. . | |
| 4,653,986 | 3/1987 | Ashton | 417/397 X |
| 4,707,952 | 11/1987 | Krasnoff . | |
| 4,723,387 | 2/1988 | Krasnoff . | |
| 4,730,991 | 3/1988 | Handfield | 417/397 |
| 4,747,758 | 5/1988 | Saurwein . | |
| 4,818,191 | 4/1989 | Schlake | 417/397 |
| 4,818,194 | 4/1989 | Saurwein . | |
| 4,820,136 | 4/1989 | Saurwein . | |
| 4,836,455 | 7/1989 | Munoz . | |
| 4,848,671 | 7/1989 | Saurwein . | |
| 4,872,615 | 10/1989 | Myers . | |
| 4,872,975 | 10/1989 | Benson . | |
| 4,895,492 | 1/1990 | Bittel et al. . | |
| 4,937,985 | 5/1991 | Boers et al. | 51/410 |
| 5,018,670 | 5/1991 | Chalmers | 51/439 |
| 5,092,744 | 3/1992 | Boers et al. | 417/397 |

FOREIGN PATENT DOCUMENTS

| | | | |
|---|---|---|---|
| 448906 | 10/1991 | European Pat. Off. | 417/397 |
| 2039996 | 8/1980 | United Kingdom | 92/85 B |

*Primary Examiner*—Richard A. Bertsch
*Assistant Examiner*—Roland G. McAndrews, Jr.
*Attorney, Agent, or Firm*—Haugen & Nikolai

[57] ABSTRACT

A cushioning means for an intensifier for delivering ultra high pressure water to the cutting head of a water jet cutting apparatus. The intensifier has a power piston and cylinder assembly connected to secondary fluid pumping piston members which extend into pumping chambers located at opposite ends of the hydraulic piston and cylinder assembly, and in a common housing. Inlet poppet valves located in the pumping chambers control the flow of water from inlet passage into the pumping chambers while outlet poppet valves allow ultra high pressure water to be pumped out of the pumping chamber into an accumulator fluidly connected to the cutting head. Hydraulic fluid under pressure is sequentially directed to opposite ends of the piston and cylinder assembly, with the piston and cylinder assembly being provided with cushioning means to assist in smooth deceleration of the piston during each stroke or cycle. The piston is provided with a controlled contour which is capable of providing improved smooth deceleration for the piston as it approaches the stroke limit. Additionally, a solenoid actuated reversing valve is provided to further monitor and control the reciprocating action of the piston and cylinder assembly.

3 Claims, 5 Drawing Sheets

FLUID CUSHIONING APPARATUS FOR HYDRAULIC INTENSIFIER ASSEMBLY

CROSS-REFERENCE TO RELATED PATENT

The present application is an improvement over the invention disclosed in U.S. Pat. No. 5,092,744 issued Mar. 3, 1992 entitled "INTENSIFIER", and assigned to the same assignee, with the subject matter thereof being incorporated by reference into this application.

BACKGROUND OF THE INVENTION

The invention relates generally to reciprocating piston pumps for creating and delivering a continuous output or flow of ultra high pressure water to be utilized in water jet cutting operations, and more particularly to such piston pumps having means for cushioning the deceleration of each stroke, particularly as the change-of-direction of the reciprocating pumping member approaches. The apparatus of the present invention finds particular application in positive displacement pumps utilized for intensifier applications, particularly those having high volumetric output or capacity. Pumps of this type are utilized in both mobile and fixed industrial applications, and may be utilized for such operations as coating removal, surface cleaning, water jet and abrasive jet cutting. The pumping apparatus of the present invention is particularly designed to function in a cushioning application for an intensifier utilized for water jet cutting apparatus operably adapted to generate and deliver water at ultra high pressure for delivery to a cutting head that discharges or delivers the ultra high pressure water as a high velocity jet for undertaking cutting operations on a workpiece. A high velocity jet of water into which an abrasive material is dispersed may be utilized for cutting workpieces fabricated from materials having hard and/or brittle mechanical properties, with these materials being otherwise difficult to cut or bore through conventional mechanical techniques.

While it is desired that intensifier pumps operate at high rates, it has been found that reciprocation rates are limited. One primary limitation imposed upon reciprocation rates is the rate at which impact occurs between the piston face and the end cap. Conventional intensifiers are limited to a maximum reciprocation rate or stroke rate of about 60 cycles per minute, this being the rate that impact may occur. When it becomes desirable to increase the volumetric output or capacity, conventional techniques would select either a larger displacement per stroke or increase the number of intensifier units. The present invention provides an additional solution in that a cushion design is provided which helps decelerate the piston as it approaches the point at which it changes direction of travel. With the improved cushioning apparatus of the present invention, intensifier apparatus have been found to perform more smoothly and at higher reciprocation rates, with a typical maximum rate being increased to a range of about 85 cycles per minute.

SUMMARY OF THE INVENTION

The improved intensifier of the present invention is particularly adapted for use in combination with water jet cutting pumps or intensifiers, and it effectively and efficiently increases the pressure of a source of water to an ultra high pressure range up to 60,000 psi or greater. The intensifier has a centrally disposed hydraulically driven double-acting power piston and cylinder assembly operable to reciprocate duplex plungers or piston members in opposed pumping chambers to generate a flow of ultra high pressure water. Inlet poppet valves located within each of the pumping chambers control the flow of water from inlet passages into the pumping chambers. Outlet poppet valves in each chamber allow ultra high pressure water to flow from the pumping chambers into outlet passages leading either to an accumulator or directly to the cutting head and discharge nozzle where the water is directed toward a workpiece as a highly delineated, high velocity jet. The hydraulically driven power piston includes a coupling arrangement which comprises a secondary cylinder or chamber arranged to accommodate a hydraulically actuated drive stroke cushioning means. Each of the secondary chambers is in direct communication with the central chamber in which the double-acting power piston is disposed and on opposite ends of the power piston. A solenoid operated valve selectively directs and vents hydraulic fluid under pressure to the drive system through the secondary chambers to reciprocate the drive piston and the duplex plungers connected thereto. Motion controlling or cushioning sleeves with their leading or forward ends formed as truncated cones or ramps with controlled profiles are interposed between the piston and each of the plungers. These cushioning sleeves are positioned to enter the secondary chambers at stroke-end, and thus operate to control the flow of hydraulic fluid to and from the chamber, and thus affect the reciprocatory motion of the assembly at the end of each stroke so that the motion of the drive piston and plunger is smoothed while the supply of ultra high pressure water is created. The controlled profiles on the sleeves together with an ultimate close-tolerance fit with the walls of the secondary chambers provide the smooth deceleration and cushioning of each stroke of the pump and its assembly of components. This arrangement has been found helpful in anticipating the stroke limit and initiating the change of direction of motion for the pistons.

The flow of hydraulic fluid to and from the piston and cylinder assembly is controlled by solenoid actuated valves. Switches are connected to the solenoids to control their function. Motion transfer structures or sensors operatively associate or mechanically couple the switches with the surface of the profiled sleeves whereby the switches are sequentially actuated in response to the sensed position of the sleeves. In other words, the sensors move in response to the changes created by the ramp or sleeve profile, thereby causing reversal of the flow of hydraulic fluid to occur at opposite ends of the central drive chamber to reciprocate the drive piston and the duplex plungers. Since the drive piston and plungers reciprocate at relatively high speeds, it is essential to sense the position of the drive piston when the stroke approaches reversal. In this manner, the motion transfer structures sense the positions of the ramps on the sleeves to change stroke direction prior to impact of the piston on the end heads, thus utilizing substantially all of the available piston stroke. Additionally, the controlled profile of the sleeves and the close tolerance with the secondary cylinder walls functions to control the available area of the fluid flow path, and thus provide hydraulic cushioning for the drive piston and duplex plunger assembly in anticipation of its reaching stroke-end.

The piston and cylinder assembly comprises a generally cylindrical casing or cylinder having first and second opposed ends, and an inside cylindrical wall surrounding an internal drive chamber. A double-acting piston is slidably located in the main chamber for movement between the first and second ends of the casing, with fluid under pressure being selectively supplied and vented from the opposed ends of the main chamber. Concentrically arranged extension bores are provided at opposed ends of the main chamber, with these extension bores forming secondary chambers with fluid passageways to accommodate the flow of hydraulic fluid to and from the main chamber. These secondary chambers also receive the profiled sleeve portion of the piston as stroke-end approaches. It is the motion and disposition of the profiled sleeve entering and moving into the secondary chambers which modifies the flow path for the hydraulic fluid to provide a portion of the controlled deceleration and cushioning for the piston prior to stroke-end and subsequent change of direction for each cycle. The solenoid actuated valve controls the flow of pressurized fluid through the passageway and to the secondary chamber to provide additional control of the deceleration. The opposed ends of the drive chamber are each further provided with aligned passages for accommodating mechanical coupling or linking of the drive piston to the fluid pumping piston members or plungers connected to opposed sides or ends of the piston, with the secondary chambers forming a portion of the axial length of the aligned passages. The opposite side walls of the pistons have recesses that accommodate flanges or sleeves connected to the piston members. Rings secured to the piston engage the flanges to retain the flanges in the recesses with limited radial clearance to allow for modest parallel misalignment when the intensifier is being assembled. The outer ends of the piston members extend through the aligned passages and into the pumping chambers.

A control device responsive to the reciprocating movements and position of the drive piston actuates the valve means to reverse the flow of pressurized hydraulic fluid to the chamber on opposite sides of the drive piston. The profiled sleeves which reciprocate into and out of the secondary chambers have profiled or truncated conical ramp portions that are tapered inwardly away from the drive piston and toward the longitudinal axis of the piston. The control means further includes electrical switches connected to the solenoids of the valve with sensing fingers for the solenoids being mounted adjacent the secondary chambers. Each sensing finger is engageable with one tapered sleeve along its ramp portion to responsively actuate the solenoid switch when the piston has moved to a position approaching the end-of-stroke. The valve is actuated to initiate reversal of the flow of hydraulic fluid to the drive chamber to cause reciprocation of the drive piston and piston members. While this feature has been found to accomplish stroke cushioning without compromising pump efficiency, the profiled ramp portion, as indicated above, provides added control of flow of hydraulic fluid to further cushion deceleration and smooth the reversal of piston motion. This added control feature allows for maximum cycling rate to be increased by about 25%.

Therefore, it is a primary object of the present invention to provide an improved reciprocating piston pump for delivering a continuous output or flow of ultra high pressure water, and to cushion the motion of the reciprocating drive pistons so as to minimize shock loading in the system.

It is a further object of the present invention to provide an improved reciprocating piston pump for ultra high pressure water, with the arrangement being provided with an improved hydraulic cushioning means to control deceleration and initiate change-of-direction of motion of the reciprocating pistons.

Other and further objects of the present invention will become apparent to those skilled in the art upon a study of the following specification, appended claims, and accompanying drawings.

IN THE DRAWINGS

DESCRIPTION OF A TYPICAL APPLICATION OF THE PRESENT INVENTION

Figure 1:
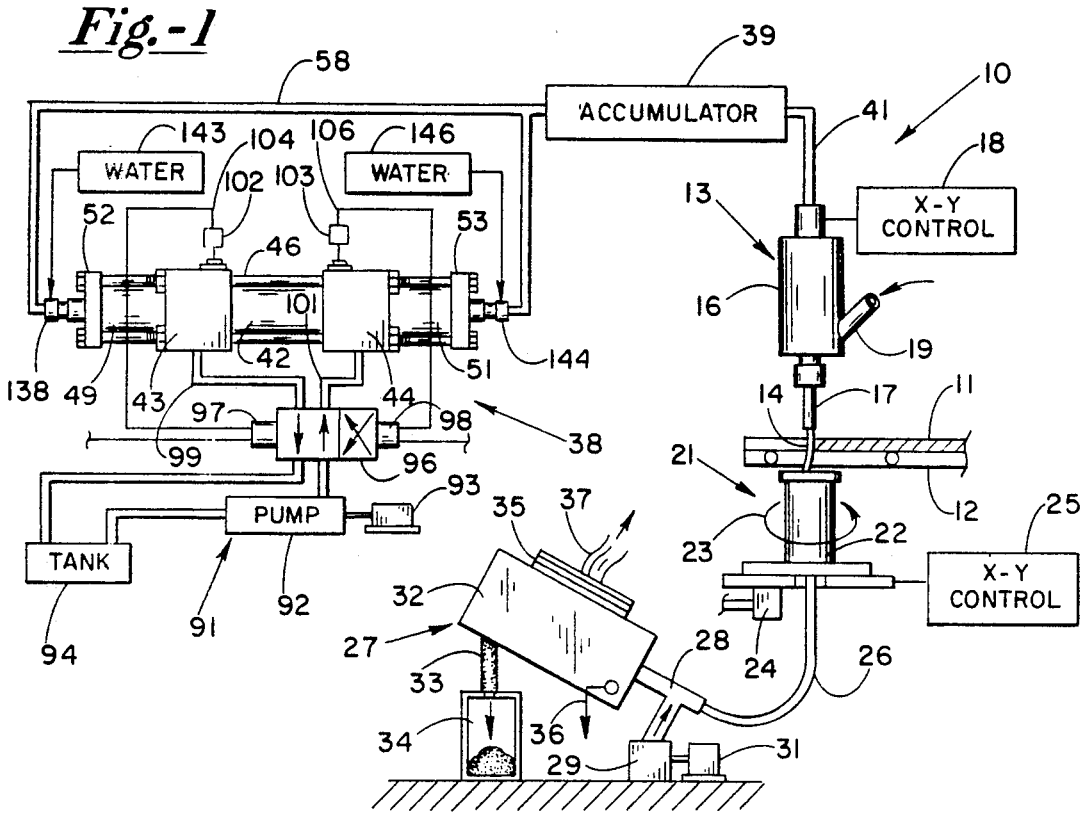
FIG. 1 is a typical diagrammatic view of one embodiment of an abrasive water jet cutting system utilizing a water pressure intensifier equipped with the cushioning apparatus of the present invention, with FIG. 1 being employed to illustrate a typical operational embodiment in which the cushioning apparatus of the present invention finds particular application.

As has been indicated hereinabove, the water jet cutting system illustrated in FIG. 1 is provided for illustrative purposes, and is felt to be helpful in setting forth one typical application of an intensifier device employing the cushioning feature of the present invention. Accordingly, referring to FIG. 1 there is shown a typical water jet cutting machine indicated generally at 10 for cutting a workpiece 11 located on a table 12. Machine 10 has a movable cutting head 13 that discharges an ultra high pressure water jet 14 having abrasive material or grit for cutting workpiece 11. Alternatively, an ultra high pressure water jet without an abrasive can be used to cut workpiece 11. Head 13 has a generally upright body 16 supporting a downwardly directed tubular member or nozzle 17. An X-Y control 18 is connected to body 16 to control the motion of head 13 in accordance with a computer and a program therefor (not shown). An example of cutter head 13 is shown and described in U.S. Pat. No. 5,018,670 incorporated herein by reference.

The abrasive material is a grit which may be delivered to body 16 through a tube 19 connected to an apparatus (not shown) for moving grit to body 16. Grits are commercially available. The water and grit of jet 14 along with the material cut from workpiece 11 is collected in a catcher, indicated generally at 21, located below table 12. Catcher 21 has a generally upright cylindrical housing 22 that is rotated as shown by arrow 23 with a motor 24. An example of catcher 21 is shown in U.S. Pat. No. 4,937,985, incorporated herein by reference. An X-Y control 25 connected to catcher 21 functions to move catcher 21 in accordance with the movement of cutting head 13 so that the entrance opening of catcher 21 is in a position to receive the water and grit of jet 14 along with the material cut from workpiece 11.

An elongated tube or hose 26 joined to the bottom of catcher 21 carries the water, grit and particles from workpiece 11 to an air, water, and solid separator indicated generally at 27. A Venturi air pump 28 draws the materials through hose 26 and discharges the materials into separator 27. Pump 28 is supplied with air from a blower 29 connected to an electric motor 31. Separator 27 has a large tank 32 that accommodates a conveyor (not shown) used to carry the solid materials to the upper end of tank for discharge of solid materials 33 into a container 34, such as a drum. Water 36 is drained from the lower end of tank 32. An air filter 35 mounted on top of tank 32 allows clean air 37 to be discharged into the atmosphere.

Cutting head 13 is supplied with a water under ultra high pressure in the range of 60,000 to 100,000 psi or greater, with the intensifier structure indicated generally at 38. As indicated hereinabove, somewhat lower pressures such as in the range of 25,000 psi or greater may also be found useful in certain applications. Intensifier 38 delivers a continuous supply of ultra high pressure water to an accumulator 39 connected to a line 41 leading to the top of body 16 of cutter head 13.

DESCRIPTION OF THE PREFERRED EMBODIMENT

Figure 2:
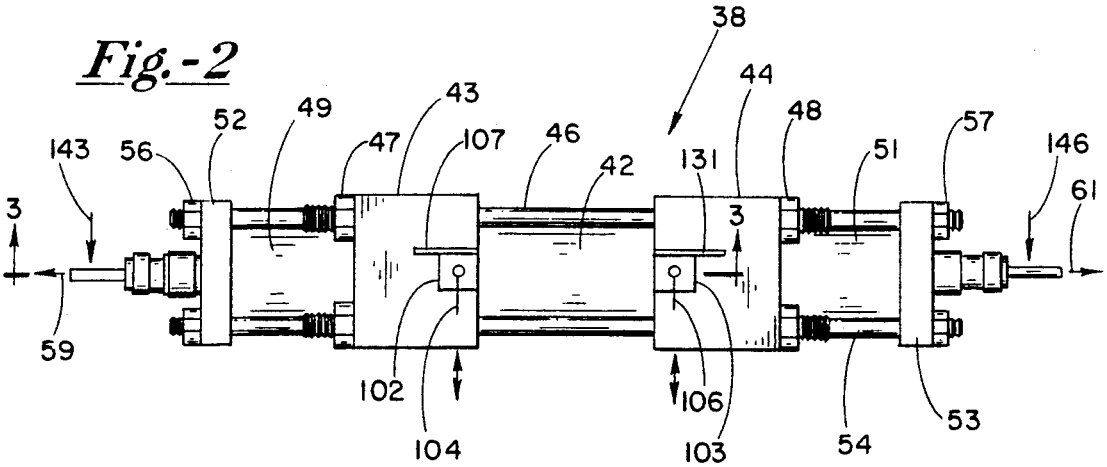
FIG. 2 is a top plan view of the water pressure intensifier shown in FIG. 1.

With attention now being directed to the detail of the intensifier apparatus, reference is made to FIG. 2. Intensifier 38 has a central power cylinder 42 comprising a piston and cylinder assembly closed at its opposite ends with heads 43 and 44. A plurality of rods 46 extend through holes in heads 43 and 44. Nuts 47 and 48 threaded onto opposite ends of rods 46 clamp heads 43 and 44 onto opposite ends of cylinder 42. A first high pressure pump cylinder 49 is located adjacent the outer end of head 43. A similar second high pressure pump cylinder 51 is located adjacent the outside of head 44. The outer ends of cylinders 49 and 51 are closed with blocks or housings 52 and 53. A plurality of rods 54 accommodating nuts 56 and 57 clamp blocks 52 and 53 onto the outer ends of the high pressure pump cylinders 49 and 51.

Intensifier 38 is a high performance reciprocating pump operable to receive water at relatively low pressure and discharge ultra high pressure water via lines or pipes 58 to accumulator 39, indicated by arrows 59 and 61 in FIG. 2.

Figure 3:
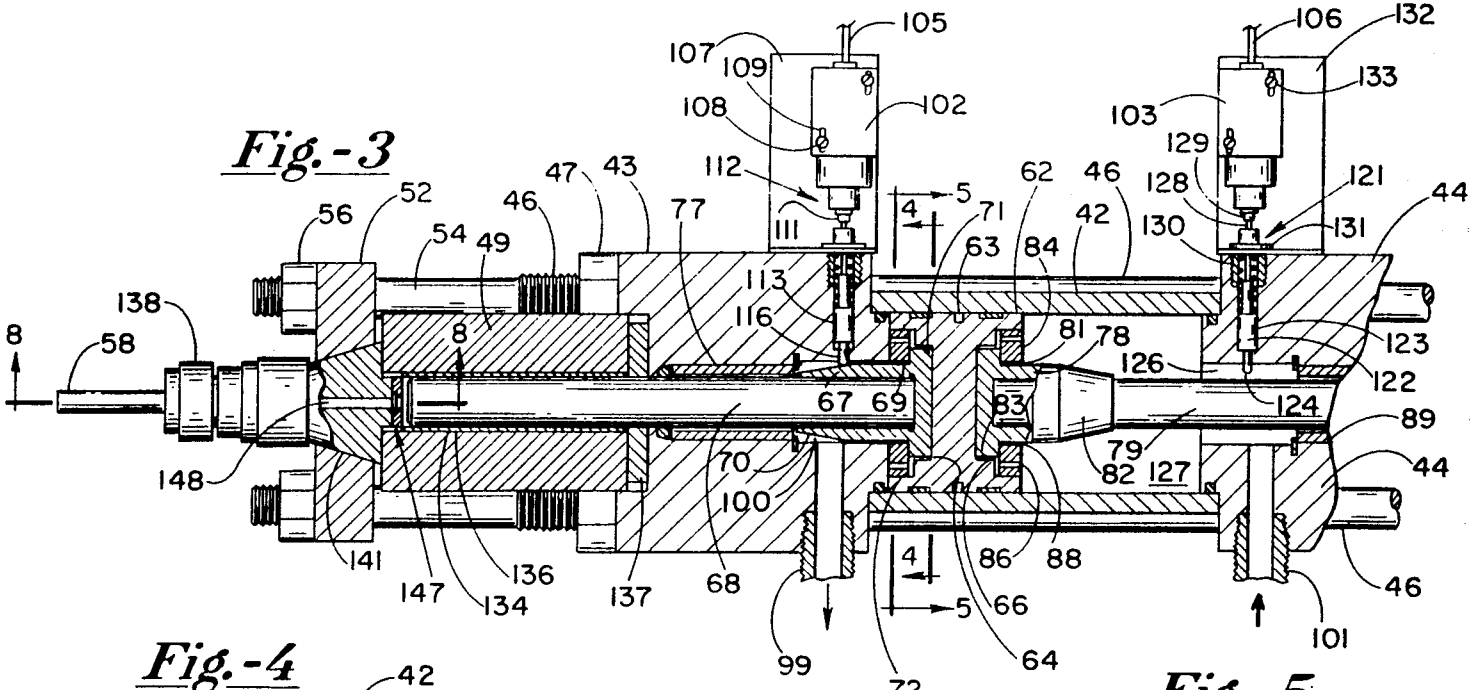
FIG. 3 is an enlarged sectional view taken along line 3—3 of FIG. 2.

Referring to FIG. 3, a piston 62 located within power cylinder 42 supports an annular peripheral seal 63 that slides on the inside surface of cylinder 42. The opposite sides of piston 62 have stepped recesses 64 and 66 that accommodate pistons or high pressure pumping plungers or piston members 68 and 79. Piston member 68 has an end located within a sleeve 67, with sleeve 67 having a longitudinal bore accommodating the end of piston member 68 with a press fit. The end of the piston member is smooth, and the shaft is free of splines, grooves or holes that may cause stress raises or other anomalies in the piston member.

As will be described in greater detail hereinafter, and for achieving the appropriate cushioning and deceleration of each stroke, sleeve 67 is provided with a selectively profiled taper along its outer surface. Sleeve 67 also has a circular shoulder or outwardly directed annular flange portion 71 and its profiled taper creates or defines a generally stepped or dual taper cone shaped nose or ramp 70. The detailed features of the profiled taper will be discussed more fully hereinafter.

Figure 5:
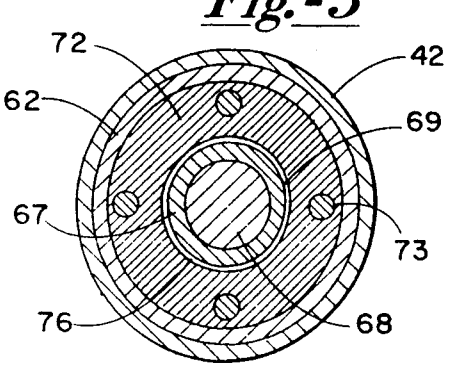
FIG. 5 is an enlarged sectional view taken along line 5—5 of FIG. 3.
Figure 4:
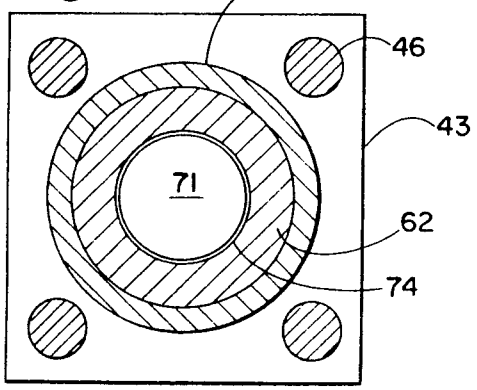
FIG. 4 is an enlarged sectional view taken along line 4—4 of FIG. 3.

With continued attention being directed to FIG. 3, outwardly directed annular flange 71 is joined to sleeve 67 at cylindrical segment or portion 69. An annular ring 72 is threaded into piston 62 to engage flange 71 and retain sleeve 67 in clearance assembled relation with piston 62. A plurality of recessed cap screws received in bores 73 (FIG. 5) secure ring 72 to piston 62 to prevent rotation of ring 72 relative to piston 62. As shown in FIG. 4, flange 71 has an outer peripheral or circumferential surface and diameter that is smaller than the internal diameter of recess 64 thereby providing an annular space or clearance 74 between piston 62 and the outer peripheral surface of flange 71. As seen in FIG. 5, cylinder segment 69 of sleeve 67 has an outer peripheral surface that is spaced inwardly from the inner surface of annular member or ring 72 thereby providing an annular space or clearance 76. The clearance spaces 74 and 76 allow limited transverse or lateral movement of piston 72 relative to sleeve 67 to accommodate for parallel misalignments and manufacturing tolerances to insure linear reciprocal movement of piston member 68 within tubular bearing 77 located in head 43 and eliminate binding, twisting, and bending of parts.

The opposite side of piston 62 accommodates a sleeve 78 attached to piston member 79. Sleeve 78 is identical in all respects to sleeve 67, having an annular shoulder 81 and a tapered conical nose 82. The detailed discussion hereinafter dealing with sleeve 67 is, of course, applicable to sleeve 78 as well. An outwardly directed annular flange 83 is located adjacent shoulder 81. A ring or annular member 84 threaded into piston 62 engages flange 83 and retains sleeve 78 in assembled relation with piston 62. As in the opposed end, a plurality of cap screws as at 86 prevent rotation of ring 84 relative to piston 62. Flange 83 has radial clearance or space 66 to provide a clearance zone or space with respect to piston 62. Shoulder 81 has radial space or annular clearance 88 with respect to ring 84. The clearance spaces 88 and 66 allows sleeve 78 and piston 62 to have relative lateral or radial movement relative to each other to eliminate parallel misalignment and lateral binding, twisting or bending of the parts. Piston member 79 extends from sleeve 78 into a tubular bearing 89 in head 44.

With attention being redirected to FIG. 1, a hydraulic fluid pressure system indicated generally at 91 operates to sequentially supply hydraulic fluid, such as oil under pressure, to opposite sides of cylinder 42 to reciprocate piston 62. Hydraulic fluid pressure system 91 has a pump 92 driven with a motor 93, such as an electric motor. The hydraulic fluid is drawn from tank or reservoir 94 and delivered under pressure to a reversing solenoid operated valve 96. Valve 96 has a movable spool connected at its opposite ends to solenoids 97 and 98. A first line or pipe 99 connects valve 96 to head 43 to deliver hydraulic fluid under pressure to a passage 100 leading to cylinder chamber 127. Solenoid 97 is controlled with a limit switch 102 mounted on top of head 43. An electrical conductor 104 connects solenoid 97 with limit switch 102. A second limit switch 103 mounted on head 44 is connected with an electrical conductor 106 to solenoid 98. Limit switches 102 and 103 function to selectively energize solenoids 97 and 98 to cause reverse flow of hydraulic fluid under pressure to opposite sides of piston 62 thereby reciprocate piston 62 in power cylinder 42.

As shown in FIG. 3, an upright bracket 107 mounted on top of head 43 supports limit switch 102 in a generally upright position. A plurality of screws 108 secure switch 102 to a side of bracket 107. Limit switch 102 has elongated upright holes 109 which allow for vertical adjustment of limit switch 102 on bracket 107. Limit switch 102 has a downwardly directed actuator 111 located in operative relationship relative to a linear motion transfer assembly indicated generally at 112 in FIGS. 6 and 7. Assembly 112 has a cylindrical body 113 reciprocally located in a radial bore 114 in head 43. A downwardly directed sensing finger 116 joined to body 113 extends into passage 100 in the traveling path of sleeve 67. The upper end of body 113 is joined to an upright rod 117 that extends through a cap 118 and engages actuator 111. Cap 118 is threaded into bore 114 to secure the linear motion transverse assembly to head 43. A coil spring 119 surrounding rod 117 biases body 113 and sensing finger 116 in an inward direction as shown in FIG. 7. Returning to FIG. 6, when profiled taper 67A of ramp 70 engages finger 116, body 113 moves up in bore 114 so that rod 117 actuates limit switch 102, thereby reversing valve 96, terminating the supply of hydraulic fluid to chamber 127 and providing hydraulic fluid directly to passage 100. This reverses movement of piston 62 in cylinder 42.

A linear motion transfer assembly 121 having the same structure as motion transfer assembly 112 is associated with limit switch 103 mounted on head 44. As seen in FIG. 3, linear motion transfer assembly has an upright cylindrical body 122 slidably located in a radial bore 123 in head 44. A downwardly directed sensing finger 124, joined to body 122, extends into passage or counterbore 126 open to cylinder chamber 127. An upright rod 128, joined to body 122, engages actuator 129 of limit switch 103. A cap 131 threaded into body 44 retains the linear motion transfer assembly on head 44. A coil spring 130 engageable with cap 131 and body 122 biases finger 124 inwardly into passage 126. An upright bracket 132 secured to head 44 supports limit switch 103 in a vertical position. A plurality of screws 133 extended through upright slots secure limit switch 103 to a side of bracket 132. The upright slots allow limit switch 103 to be vertically adjusted thereby changing the time in which limit switch 103 would be actuated in response to movement of finger 124 on engagement with cone shaped nose 82 of sleeve 78.

As shown in FIG. 3, when piston 62 is to be moved to the left, the application of fluid under pressure to chamber 127 provides the force required, and sleeve 67 will move into passage 100. The profiled taper of cone shaped nose 70 engages the bottom of sensing finger 116, thereby moving body 113 and rod 117 upwardly to actuate limit switch 102. This causes valve 96 to reverse the direction of flow in response to the energization of solenoid 97. The flow of fluid under pressure being supplied through passage 100 to chamber 127 is terminated prior to the time that piston 62 and ring 72 engage the end of head 43. The profile of the outer taper of sleeve 67 approaches and enters the area or zone where communication is provided to passage 100. As the sleeve 67 moves further to the left, the area available for the flow of hydraulic fluid to exhaust the left-hand portion of the chamber decreases, thus providing fluid-dampened controlled deceleration or cushioning of the motion of piston 62 prior to its undergoing a change of direction. This feature reduces contact between piston 62 and head 43, thus minimizing creation of shock and/or pounding in the system. The timing of the reversing of valve 96 can be adjusted by vertically adjusting the position of limit switch 102 on bracket 107. This adjustment alters the length of stroke of piston 62. On application of fluid under pressure to passage 100, piston 62 will move to the right as seen in FIG. 3. The fluid in chamber 127 flows through secondary chamber or passage 126, line 101, through valve 96 back to reservoir or tank 94. As piston 62 approaches head 44, the profiled taper defining cone shaped nose 82 of sleeve 78 engages finger 124 to actuate limit switch 103. The cushioning and deceleration of piston 62 while moving to the right as seen in FIG. 3 is accomplished in the same fashion as that previously described in connection with profiled taper of sleeve 67. Valve 96 shifts as solenoid 98 is energized, thereby reversing the flow of hydraulic fluid under pressure to a selected one of the chambers disposed on opposite sides of piston 62. Piston 62 continuously reciprocates in response to the action of valve 96 so long as the pump 92 supplies hydraulic fluid under pressure.

Figure 6:
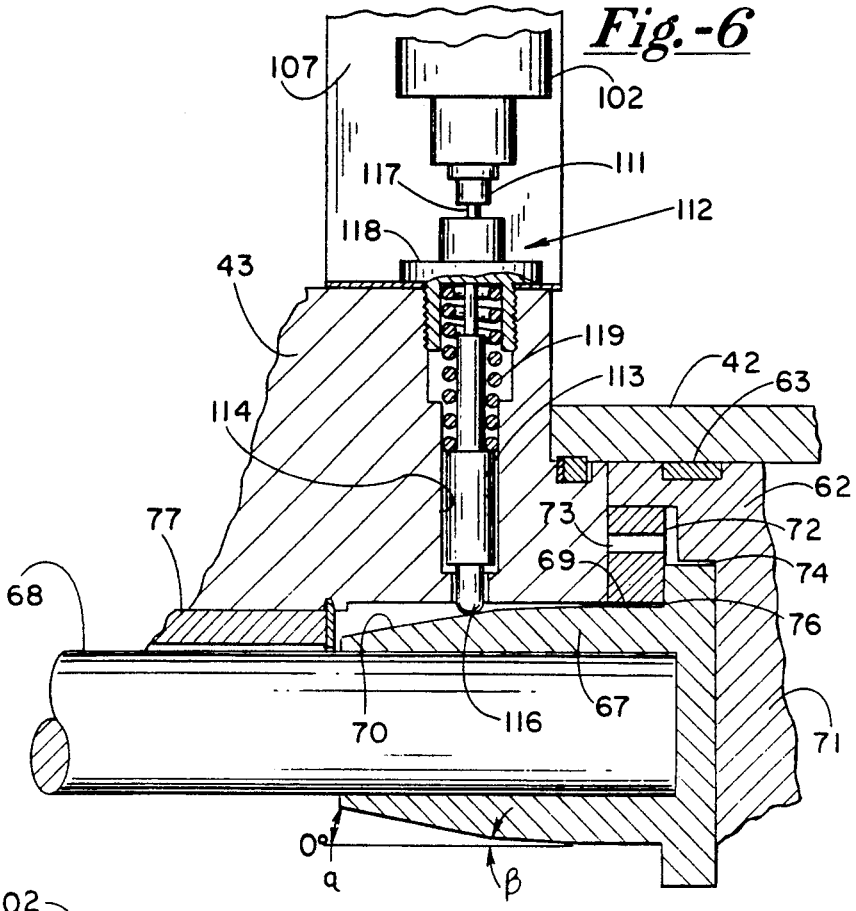
FIG. 6 is an enlarged fragmentary sectional view, partially broken away, of one motion transfer assembly and switch mechanism of the intensifier of FIG. 3 illustrating the profiled sleeve at stroke-end disposition, and with the switch being in the on position.
Figure 7:
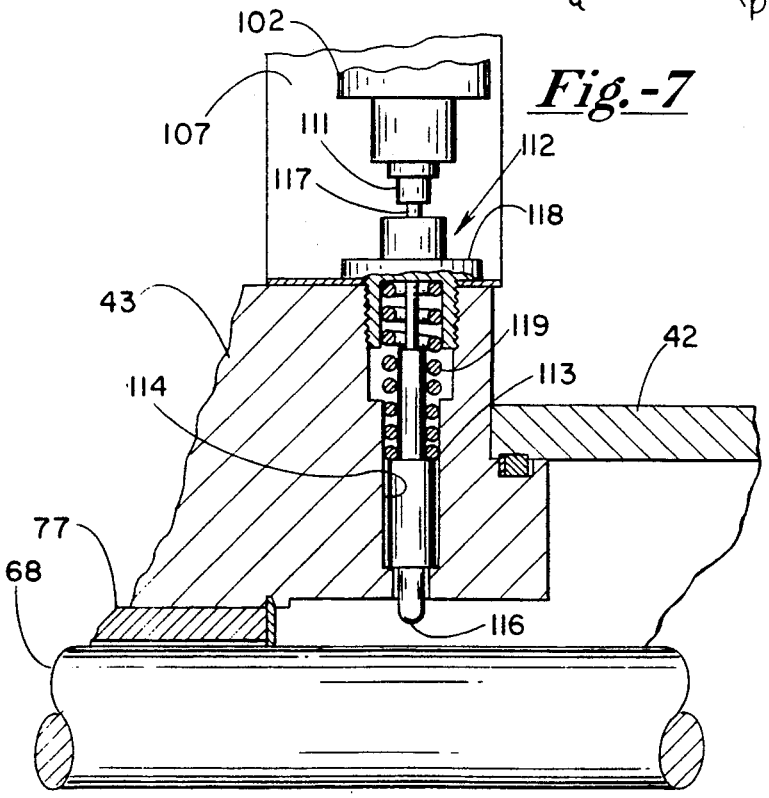
FIG. 7 is a sectional view of the motion transfer assembly and switch similar to FIG. 6 but with the switch being in the off position.

Turning now to the detail illustrated in FIG. 6, it will be observed that profiled taper of sleeve 67 converges inwardly away from piston 62 along two truncated cone segments, with each segment having its own separate ramping or cone angle. Preferably, the outer or distal tip portion of the profile taper defining ramp 70, as indicated by the angle $\alpha$, is approximately 9.58°. This angular relationship may be modified somewhat, and a suitable angular range has been found to be between 8° and 10°. The more proximal end of profiled tapered sleeve 67, as defined by angle $\beta$, is preferably 2°. In this arrangement, an angular range of between 1° and 3° may be found useful. By way of specific example, in a system having a total stroke length of 4.5 inches, the clearance between the outer diameter of sleeve 67 and the inner diameter of secondary chamber 126 may range from between 0.008 and 0.0012 inch. This narrow constriction, when arranged in combination with the profiled taper has been found to produce significant smoothing and cushioning of the drive motion. In other words, as the profiled taper extends into chamber zone or passage 100, the area for flow and/or discharge of hydraulic fluid becomes more and more constricted. By utilizing a profiled taper, therefore, the creation of an abrupt or sudden increase in the constriction is avoided, with the result being a relatively smooth dampening and/or cushioning effect upon the motion of the mechanism. It will, of course, be understood that the oppositely disposed arrangement including profiled taper sleeve 78 is identical in structure and function to that previously described and need not be repeated here.

Figure 8:
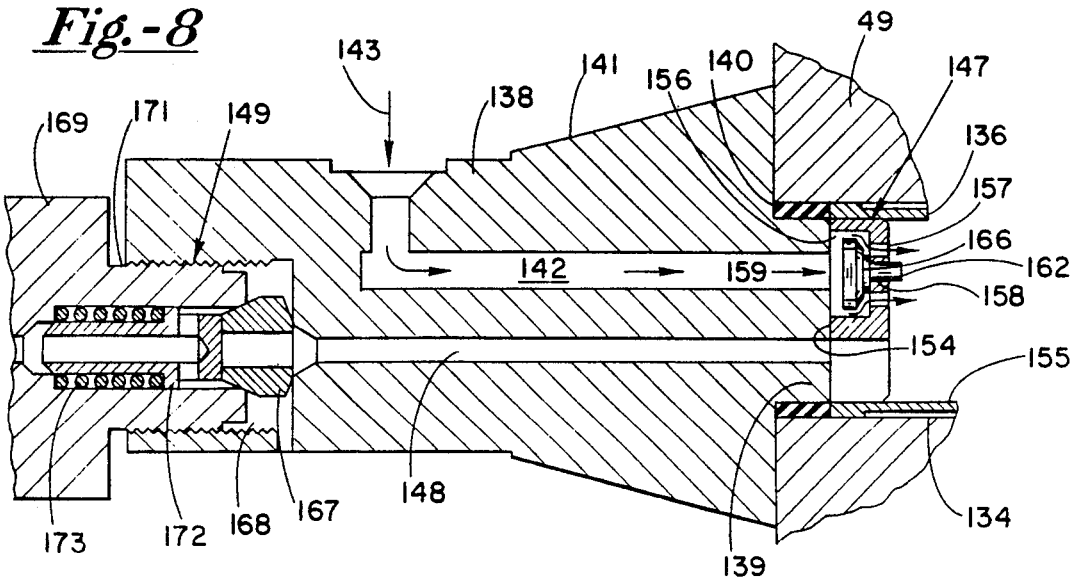
FIG. 8 is an enlarged sectional view taken along the line 8—8 of FIG. 3 showing the water inlet poppet valve in the open position.
Figure 9:
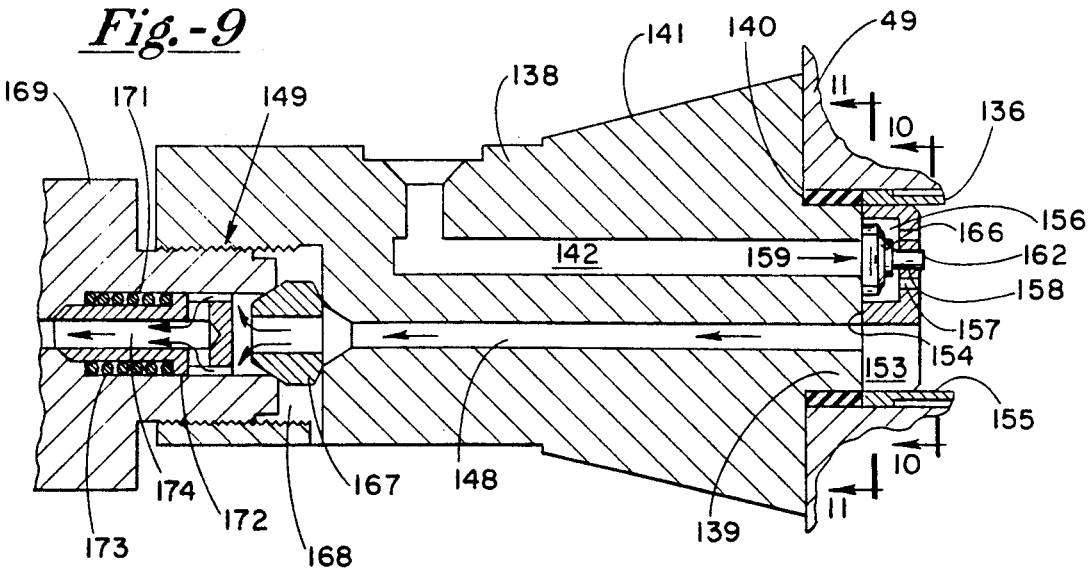
FIG. 9 is a sectional view similar to FIG. 8 showing the water inlet poppet valve in the closed position.
Figure 10:
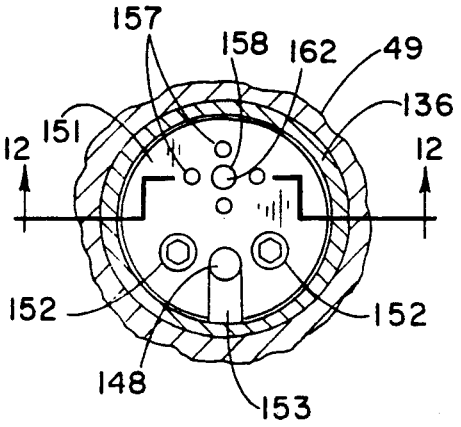
FIG. 10 is an enlarged sectional view taken along line 10—10 of FIG. 9.

Returning to FIG. 3, high pressure pump cylinder 49 has a central axial bore 134 accommodating a sleeve or tube 136 having an internal cylindrical surface located in sliding sealing engagement with the outside peripheral surface of piston member 68. Plate 137 which is interposed between cylinder 49 and head 43 retains sleeve 136 in assembled relation with cylinder 49 and also insures the seals at opposite ends of tube 136 are retained in place. A high pressure housing 138 is located in engagement with the outer end of cylinder 149. As shown in FIGS. 8 and 9, high pressure housing 138 has a cylindrical boss 139 that extends into bore 134. An annular seal 140 surrounds boss 139. High pressure housing 138 has an external cone face 141 that fits into a tapered hole in plate 52 whereby plate 52 retains housing in tight sealing relation with cylinder 49.

High pressure housing 138 has a water inlet passage 142 connected to a water supply 143. Passage 142 leads through boss 139 to a low pressure inlet poppet valve assembly indicated generally at 147. Inlet poppet valve assembly 147 is located within pump chamber 155 to reduce fatigue failures of the body 138 of the valve assembly. The opposite end of intensifier has a second high pressure housing 144 secured with plate 53 to the end of cylinder 51. Housing 144 is connected to a water supply 146. The internal components of housing 144 are identical to the housing 138 including the lower pressure inlet poppet valve assembly 147 and the high pressure outlet poppet valve 149 as shown in FIGS. 8 and 9. Housing 138 has a linear outlet passage 148 generally parallel to the inlet passage 142 leading from pump chamber 155 to the high pressure outlet poppet valve assembly 149.

Figure 11:
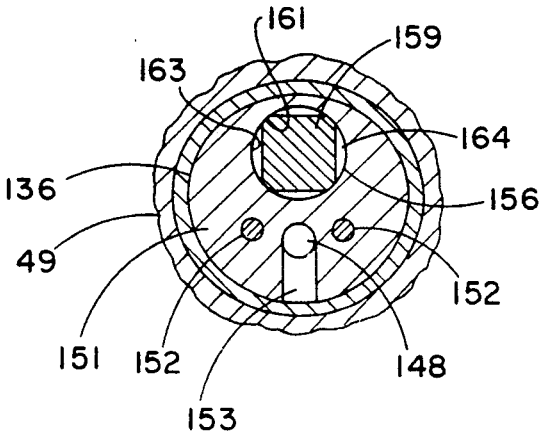
FIG. 11 is an enlarged sectional view taken along line 11—11 of FIG. 9.
Figure 12:
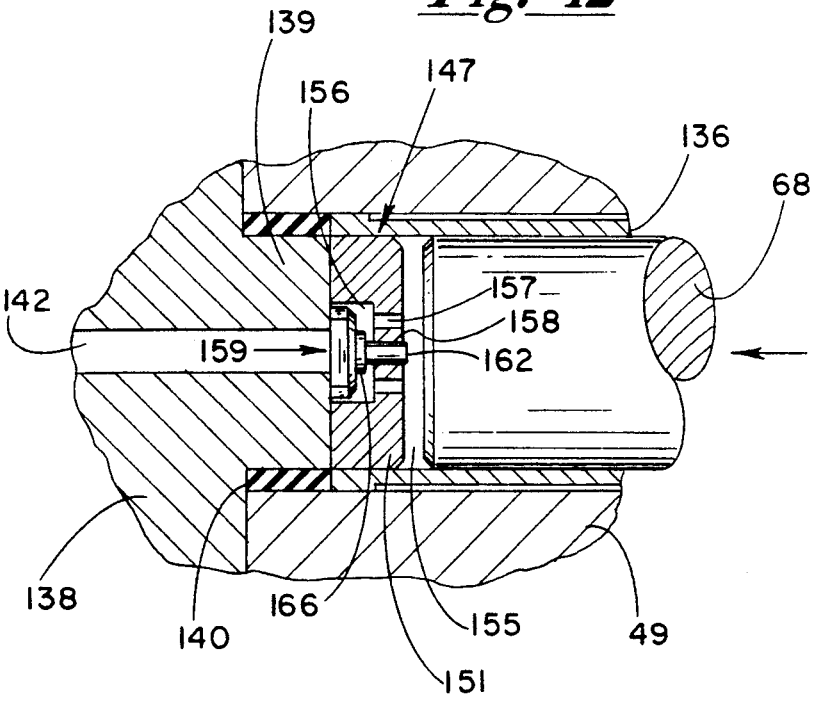
FIG. 12 is an enlarged sectional view taken along line 12—12 of FIG. 10.

As shown in FIGS. 8 to 12, low pressure inlet poppet valve assembly 147 has a cylindrical housing or body 151 located in engagement with the end of boss 139 at the end of pumping chamber 155. Valve assembly 147 has a low profile and closes the end of pumping chamber 155, as shown in FIG. 12. A plurality of cap screws 152 secure body 151 to boss 139. Body 151 has a downwardly directed slot 153 in registration with water outlet passage 148 of housing 138 to allow for free flow of water from high pressure pumping chamber 155 to outlet passage 149 leading to high pressure outlet poppet valve assembly 149. The face 154 of body 151 is flat and in surface engagement with the outer flat face of boss 139. Body 151 has a circular recess or pocket 156 open to face 154. A plurality of holes 157 surrounding a center hole 158 are open to pocket 156 and pumping chamber 155. A floating valving member indicated generally at 159 located in pocket 156 moves generally parallel to the longitudinal axis of the pumping chamber 155 between an open position as shown in FIG. 8 and a closed position as shown in FIG. 9 without the use of a biasing spring. Valving member 159 has a generally square shape with curved corners or outer arcuate edges 161 and an axial stem 162 extended through central hole 158. The outer arcuate edges 161 and stem 162 guide and control the linear open and closing movements of valving member 159 and allow rotation of valving member 159 about its axis of movement. As shown in FIG. 11, inner wall 163 in body 151 is larger than valving member 151 thereby providing spaces or areas 164 around valving member 159. The cross-sectional area of spaces 164 is smaller than the combined cross-sectional areas of holes 157 in body 151. Also, the combined cross-sectional area of holes 157 is smaller than the cross-sectional area of water inlet passage 142 to provide a pressure drop across valve member 159 during the pumping of water from pump chamber 155. When piston member 68 moves away from low pressure inlet poppet valve assembly 147, valving member 159 will move to an open position wherein shoulder 166 surrounding stem 162 will engage body 151 to provide a flow passage around valving member 159 as seen in FIG. 8. This allows the water to flow into pump chamber 155. When piston member 68 is moved in the opposite direction toward low pressure inlet poppet valve assembly 147, valving member 159 will quickly close since spaces 164 restrict reverse flow of water into passage 142. The restricted flow is due to the smaller cross-sectional area of spaces 164 relative to the total cross-sectional areas of holes 157 and the smaller total cross-sectional areas of holes 157 relative to the cross-sectional area of passage 142. As shown in FIG. 9, when valve member 159 is in the closed position, the flat face of valve member 159 is in surface engagement with an annular seat or surface of boss 139 surrounding inlet opening 142. Valve member 159 has a relatively short travel distance between its open and closed positions and a fast valving time cycle.

High pressure outlet poppet valve assembly 149 has a seat 167 comprising an annular member located adjacent the outer end of the water outlet passage 148. Seat 167 is located in a threaded bore 168 in the outer end of high pressure housing 138. A connector 169 threaded into bore 168 holds seat 167 in fixed relationship relative to housing 138. Connector 169 has a passage 171 accommodating a movable check valve 172. A spring 173 biases check valve 172 into closed relationship relative to seat 167 as seen in FIG. 8. When the pressure in pumping chamber 155 is sufficient to overcome the force of spring 173 and the high pressure of the water in line 58, check valve 172 will move to the open position to allow high pressure water to flow through passage 148, check valve passage 174 and into line 58. The high pressure housing 144 at the opposite end of the intensifier has an identical check valve for controlling the flow of water into line 58 leading to the accumulator 39.

In use, pump 92 together with valve 96 is operable to supply hydraulic fluid under pressure selectively to opposite ends of chamber 127 of cylinder 42 to thereby reciprocate piston 62. Piston 62 is connected to the piston members 68 and 79, thereby creating the force necessary to cause the reciprocating motion of the piston members 68 and 69 in high pressure cylinders 49 and 51. The limit switches 102 and 103 selectively reverse valve 96, and these together with the cushioning obtained from profiled tapers of sleeves 67 and 78 within their respective secondary chambers serve to smooth and cushion the stroke of piston 62. The linear motion transfer assemblies 112 and 121 mounted on heads 43 and 44 are normally disposed relative to the profiled tapers of sleeves 67 and 78 so as to actuate the valve to determine, limit and otherwise control the extent of travel or positioning of piston members 68 and 79. Limit switches 102 and 103 are sequentially actuated by movement of tapered sleeves 67 and 78 of ramp portions 70 and 82 of sleeves 67 and 78 into engagement with sensing fingers 116 and 124. Limit switches 102 and 103 are vertically adjustable on their supporting brackets 107 and 132 respectively to change the point at which the limit switches 102 and 103 are actuated to thereby change each stroke limit or stroke-end of piston 62 in cylinder 42. Because of the cushioning capability, the system has been found to function more efficiently, with a greater portion of the overall stroke of piston 62 being effectively utilized. The motion transfer assemblies 112 and 121 are normally disposed adjacent piston members 68 and 79 to provide a compact structural arrangement without interference with the stroke or travel of piston members 68 and 79.

During the intake stroke of piston member 68, the inlet poppet valve member 159 moves to the open position whereby water under relatively low pressure flows through inlet passage 142 around valve member 159 and through holes 157 into pumping chamber 155. The open position of valve member 159 is shown in FIG. 8. When the direction of movement of piston member 68 is reversed, piston member 58 moves toward valve member 159 whereby the pressure of the water in pumping chamber 155 substantially increases to the ultra high pressure range causing valving member 159 to quickly close. The difference in the pressure between the pumping chamber 155 and inlet passage 142 maintains the valving member 159 closed. The high pressure water flows through the outlet passage 148 through check valve 149 and into pipe 58 leading to accumulator 39. The ultra high pressure water flows through pipe 41 to head 13. The water is discharged at a high velocity and high pressure as a jet 14 which cuts the workpiece. The grit incorporated or injected into the jet facilitates the cutting operation. The water from the jet, grit, and material from the workpiece is collected with the catcher 21 and delivered to liquid solid separator 27 which separates air, solids, and water.

While there has been shown and described one preferred embodiment of the intensifier for the water jet cutting machine of the present invention, it will be understood that modifications may be made in the structure by those skilled in the art without departing from the invention. The invention is defined in the following claims.

We claim:

1. Means for decelerating and cushioning the stroking motion of a reciprocating plunger in the drive portion of a hydraulic intensifier apparatus and comprising:

(a) casing means defining a central power chamber with opposed end walls and with each of said end walls having an elongated bore formed therethrough and with a counterbore formed adjacent each end of said power chamber to form opposed secondary chambers in axial extension with said central power chamber;

(b) double-acting drive piston means sealingly arranged in said chamber intermediate said end walls and adapted for reciprocatory to-and-fro stroking motion therewithin;

(c) fluid inlet and outlet port means disposed within each of said end walls for controlled introduction of pressurized hydraulic fluid to said secondary chamber and for exhaustion of hydraulic fluid therefrom for forcing said drive piston in its stroking motion;

(d) a pair of opposed pumping chambers within said casing means and being disposed outwardly of said opposed end walls, a secondary fluid pumping piston means within each of said pumping chambers coupled to the drive piston means and adapted for reciprocatory pumping motion therewithin;

(e) first and second opposed secondary fluid piston means secured to opposite ends of said drive piston, with each of said first and second fluid piston means passing through the respective elongated bore and counterbore;

(f) elongated ramp means coupled to said fluid piston adjacent said power piston and arranged to reciprocate axially into said secondary chambers at the outermost point of travel of each stroke so as to position said ramp means directly inwardly of said hydraulic fluid port at stroke end, said ramp means comprising a profiled sleeve having first and second conical segments, with each of said conical segments being of different cone angles, and with the cone angle of each conical segment tapering distally of said sleeve;

(g) the arrangement being such that the profile of said elongated ramp means controllably defines and continuously increasingly restricts the flow path available for hydraulic fluid flowing between said power chamber and said secondary chamber for flow outwardly of said hydraulic fluid port into said secondary chamber as said fluid piston approaches stroke end, and continuously increases the flow path available for flow of hydraulic fluid inwardly of said hydraulic fluid port form said secondary chamber to re-enter said power chamber as said piston undergoes a change of direction while hydraulic fluid re-enters said power chamber.

2. The hydraulic intensifier as defined in claim 1 being particularly characterized in that said first conical segment having a cone angle of between about 8° and 10°, and with said second conical segment having a cone angle of between about 1° and 3°, said first conical segment being disposed distally of said second conical segment.

3. The hydraulic intensifier as defined in claim 1 being particularly characterized in that said profiled sleeve comprises a cylindrical segment disposed proximally of said conical segments, and wherein said profiled sleeve and a portion of said cylindrical segments reciprocate axially into said secondary chambers to controllably define a flow path for hydraulic fluid passing between said power chamber and said hydraulic fluid port means, with the outer circumferential surface of said cylindrical segments being disposed closely adjacent the inner diameter of said secondary chamber.

* * * * *